United States Patent [19]

Ichikawa

[11] 4,299,382

[45] Nov. 10, 1981

[54] SHEET SORTING AND STACKING APPARATUS

[75] Inventor: Kiyomichi Ichikawa, Kawasaki, Japan

[73] Assignee: Canon Kabushiki Kaisha, Tokyo, Japan

[21] Appl. No.: 79,085

[22] Filed: Sep. 26, 1979

[30] Foreign Application Priority Data

Oct. 6, 1978 [JP] Japan ..... 53-123411
Oct. 6, 1978 [JP] Japan ..... 53-123412

[51] Int. Cl.[3] ..... B65H 29/58
[52] U.S. Cl. ..... 271/287; 271/258; 271/273; 271/297
[58] Field of Search ..... 271/280, 287, 288, 289, 271/290, 292, 293, 297, 274, 258, 273

[56] References Cited

U.S. PATENT DOCUMENTS

| | | | |
|---|---|---|---|
| 3,460,824 | 8/1969 | Bahr | 271/297 X |
| 3,709,492 | 1/1973 | Baker | 271/297 X |
| 3,953,023 | 4/1976 | Cross | 271/173 |
| 4,050,690 | 9/1977 | Michelson | 271/273 X |
| 4,111,410 | 9/1978 | Tates | 271/297 X |

*Primary Examiner*—Richard A. Schacher
*Attorney, Agent, or Firm*—Fitzpatrick, Cella, Harper & Scinto

[57] ABSTRACT

A sheet sorting and stacking apparatus for sorting and storing sheet materials into plural storage positions, includes a pair of sheet conveyors for transporting sheet materials from a sheet entrance to the storage positions, an auxiliary member provided in the transport path and adapted to perform a swinging motion thereby being released together with one of the conveyors from the other so as to widen the space in the transport path and releasing device for releasing the auxiliary member upon detection of an abnormality in the sheet transport.

3 Claims, 9 Drawing Figures

SHEET SORTING AND STACKING APPARATUS

BACKGROUND OF THE INVENTION

1. Field of the Invention

The present invention relates to an apparatus for sorting and stacking sheet materials emitted from an image forming apparatus such as copier, duplicator or other recording apparatus, and more particularly to an improvement in an apparatus (hereinafter referred to as sorter) for efficiently sorting and storing sheet materials such as copy paper or recording paper (hereinafter referred to as sheets) into plural storing places according to the content of the record on such sheets.

2. Description of the Prior Art

With the progressive increase in the processing speed of image forming apparatus in recent years, it has become customary to use a sorter for automatic sorting of processed sheets in combination with such image forming apparatus in order to achieve an improved work efficiency. In such high-speed apparatus, however, the protection of the sheets in transportation and the apparatus itself in case of erroneous operation such as sheet jamming during transportation thereof is more important but more difficult to achieve.

In a combined system consisting of such image forming apparatus and a sorter, such sheet jamming may occur in the apparatus or in the sorter, and, in case of the jamming in the apparatus, the sorter may continue its function until all the sheets in transportation are sorted into appropriate trays, while in case of the jamming in the sorter, the sheet transportation in the sorter has to be interrupted immediately. In such case, however, the sheet transportation in the image forming apparatus has to be continued until all the sheet already in process in said apparatus are emitted therefrom in order to avoid undesirable effect for example by the heat source for image fixing, and for this reason the sorter has to be provided with suitable means for receiving such sheets to be emitted from the image forming apparatus. For this purpose there is already known to provide a tray for temporarily receiving the processed sheets between the image forming apparatus and the sorter or on either thereof and to activate diverting means in case of a sheet jamming thereby guiding the sheets into such emergency tray through a separate diverting path. Such conventional method is however defective in that the presence of the abovementioned emergency tray and the associated diverting means and diverting path requires a significant additional space just for an emergency case, thus increasing the volume of the entire system, and necessitates the inspection of said tray in case of jamming in addition to the ordinary transportation path, thus complicating the operation procedure and delaying the restart of normal operation.

Also the convention sorter is generally equipped with sheet transporting means for driving the sheets into appropriate trays composed of driven or idler rollers positioned at the respective entrances of sheet stacking trays and a group of rollers and/or belts engaging with the abovementioned rollers, and sheet diverting means functioning independently from said sheet transporting means and guiding each sheet to a determined tray. The sorter of such structure is however defective in that the various components have to be of a limited shaft diameter in order to avoid mutual interference between the sheet diverting means and the rollers and belts constituting the sheet transporting means which have to be positioned in a quite limited space, and that the sheet guide members performing auxiliary function in the sheet transporting means can only be employed in limited positions. For this reason such sorter is inevitably associated with a major drawback of structural uncertainty in the mutual positional relationship between the sheet transporting means and the diverting means, which can only be prevented at the sacrifice of the increase of entire volume of the sorter or of the reduction in the number of trays. Another drawback of such sorter lies in that the sheet is often not properly placed on the tray or on the stack of sheets already placed in the tray, which is called sheet end remaining phenomenon, because the sheet, in the transport into a determined tray by the activated diverting means, is merely guided between the diverting means and the roller positioned at the entrance of tray without active driving force after the release of the trailing end of the sheet from the sheet transporting means and is subjected to a curving action, thus developing a curl on said trailing end.

SUMMARY OF THE INVENTION

The object of the present invention is to provide a novel sorter not associated with the aforementioned drawbacks of the conventional sorters.

Another object of the present invention is to provide a sorter not provided with an emergency tray to be used only in case of sheet jamming and still allowing to eliminate in such case all the sheets in process in the associated image forming apparatus.

Still another object of the present invention is to improve the mutual precision of the sheet transporting means and the diverting means, and to prevent the aforementioned sheet end remaining phenomenon.

The above-mentioned objects can be achieved according to the present invention by a sorter wherein, in case of a jamming in the sorter, the sheet transporting means in said sorter is stopped and simultaneously or immediately thereafter the sheet transport path is opened to temporarily accumulate the sheets in the space created by said transport path opening. Said path opening is most preferably performed in a path position at which the sorter receives the sheets from the main apparatus because of the minimum possibility of sheet jamming and the possibility of automatic sheet accumulation even without the transporting means, said position being preferably horizontal in order to prevent sliding off of the accumulated sheets. The path opening to be used in the present invention means to widen, either vertically or laterally, the transport path formed by the rollers and/or belts for supporting the sheets on both faces thereof, said widening being achievable by parallel displacement of said rollers or belts or by rotation by a certain angle about an end thereof.

The above-mentioned structure allows to dispense with the separate tray for jamming thereby enabling to compactize the sorter, and to collect all the sheets in the transport path itself in use thus minimizing the inspection procedure after jamming and thereby enabling rapid restart of the operation.

Furthermore the aforementioned objects of the present invention can be achieved by a sorter comprising plural trays, transport rollers for guiding sheets to said trays, diverting means for changing the advancing direction of the sheet for guiding the same to a particular tray and a rotary member mounted on each of the supporting member for said diverting means, wherein said rotary member being positioned in facing relationship to each of the transport rollers thereby defining the position of said diverting means. Such structure eliminates the necessity for precise positioning of the diverting means with respect to the transport roller since the position of the diverting means is automatically defined by the shaft of said roller, and allows to prevent the aforementioned sheet end remaining phenomenon since the sheet diverted by said diverting means is securely transported to the tray by another roller.

DESCRIPTION OF THE PREFERRED EMBODIMENTS

A sorter is generally provided with 10 to 20 or even more trays for accumulating sheets, and the sheets in succession at a regular interval from a main apparatus such as a copier are sorted and accumulated into determined trays through transport means composed of belts and/or rollers.

Figure 1:
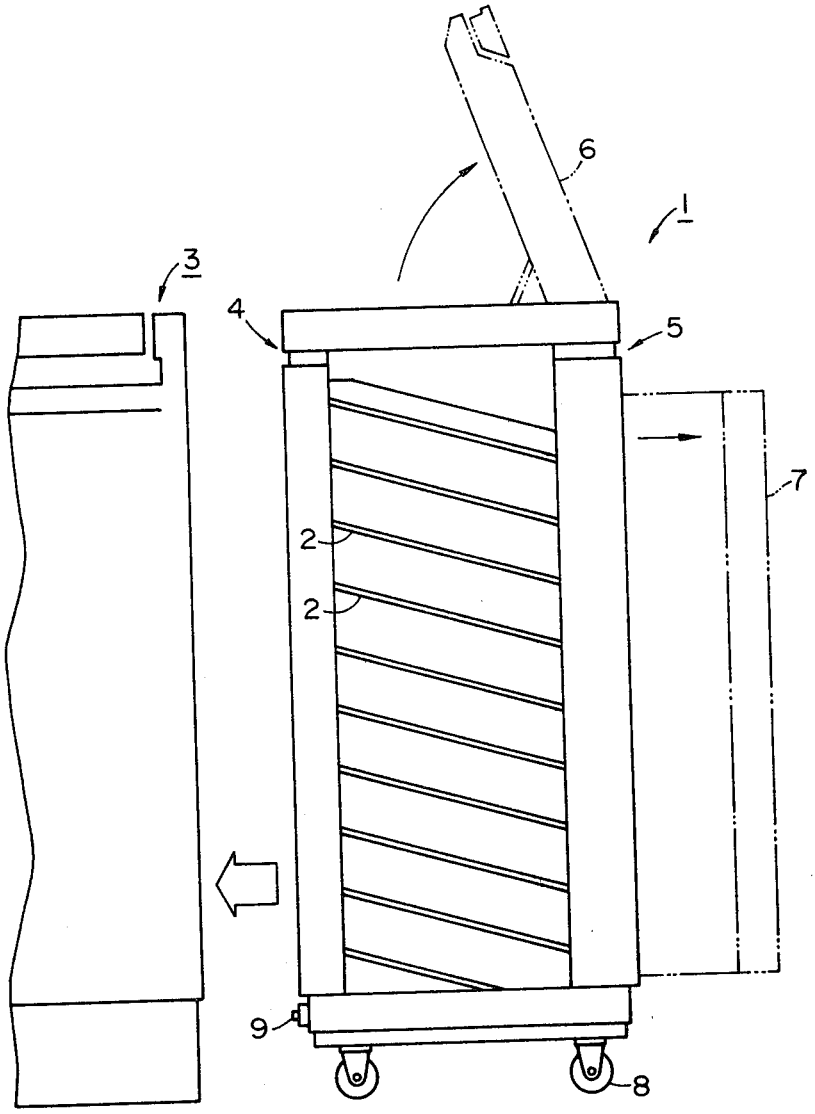
FIG. 1 is an elevation view of the sorter of the present invention.

In FIG. 1 there is shown, in an elevation view, a sorter embodying the present invention and having an aperture on the front face thereof for removing the sheets accumulated on trays 2, an entrance slot 4 at the upper left face for receiving the incoming sheets from a main apparatus 3, and an exit slot 5 for ejecting the sheets not transported to the trays. The upper portion of said sorter 1 can be opened about the right-hand end thereof as represented by double-dotted chain line so as to split the sheet transport path in the vertical direction, whereby the sheets eventually jammed in said path can be removed by opening an upper door 6 as explained in the above. On the other hand the right-hand wall of the sorter 1 can be opened in a similar manner as the upper portion as represented by double-dotted chain line so as to split a vertical transport path to be explained later, whereby the sheets eventually jammed therein can be removed by opening a right-hand door 7.

The sorter 1 is displaceable by means of castors 8 provided thereunder and can be placed at a particular position with respect to the main apparatus 3 by means of positioning member 9 provided at the lower portion of said sorter 1.

Figure 2:
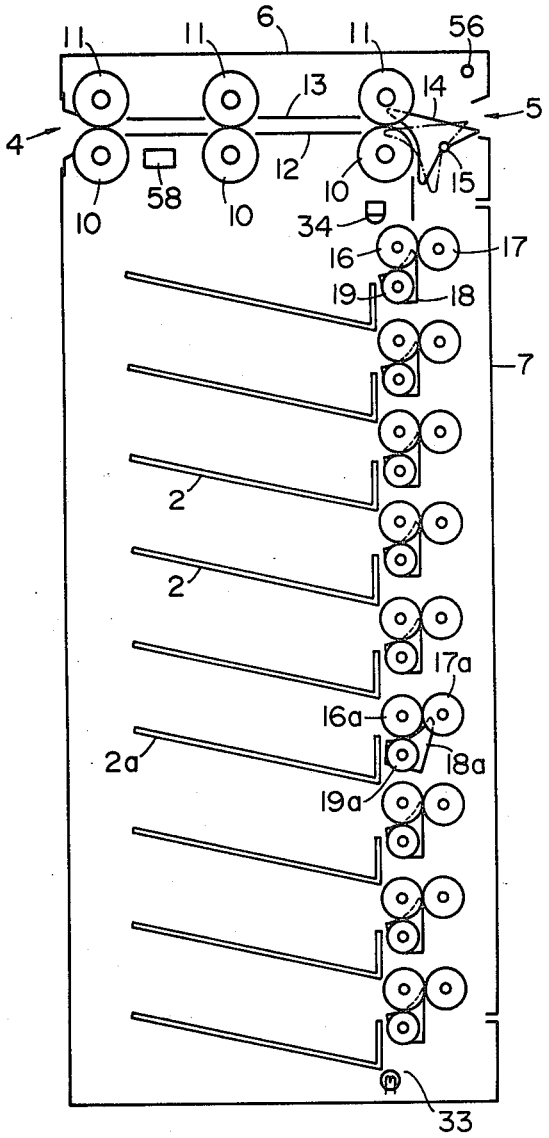
FIG. 2 is a cross-sectional view showing the principal components of said sorter.

Referring to FIG. 2 showing the principal components in said sorter 1, the sheet from said main apparatus is received through the entrance slit 4 and transported to the right along a horizontal transport path by means of three lower drive rollers 10 and three idler rollers 11 provided in said upper door 6 respectively facing said drive roller 10. 12 is a lower guide plate while 13 is an upper guide plate provided in said upper door. The sheet thus transported in the horizontal transport path is either transferred to the vertical transport path by a diverting member when it is in the full-lined position or ejected from the sorter through the exit slit 5 when said diverting member 14 is in the chain-lined position.

Said diverting member 14 is fixed on a swinging shaft 15 and is selectively positioned, electrically by a signal from the main apparatus or manually, at the full-lined or chain-lined position. The curved face of said diverting member, when it is placed in the full-lined position, functions to guide the sheet into the vertical transport path.

In said vertical transport path the sheet is transported in the vertical direction while it is supported between constantly rotated drive rollers 16 and idler rollers 17 provided in said right-hand door 7 and respectively maintained in contact with said drive rollers 16. At the entrances of the trays 2 there are respectively provided converting members 18 which are positioned, except the one for a selected tray **2*a*** into which the sheet is to be guided, so as not to introduce the sheet into the trays but to function as the guide means for the sheet.

On the other hand in case of guiding the sheet into a particular tray, the corresponding diverting member is brought into a state represented by **18*a* whereby the advancing direction of the sheet is changed from vertical to leftward. At the entrance of said selected tray 2*a* there are provided rollers 16*a*, 17*a* and an idler roller 19*a* maintained in contact with said drive roller 16*a***.

Figure 3:
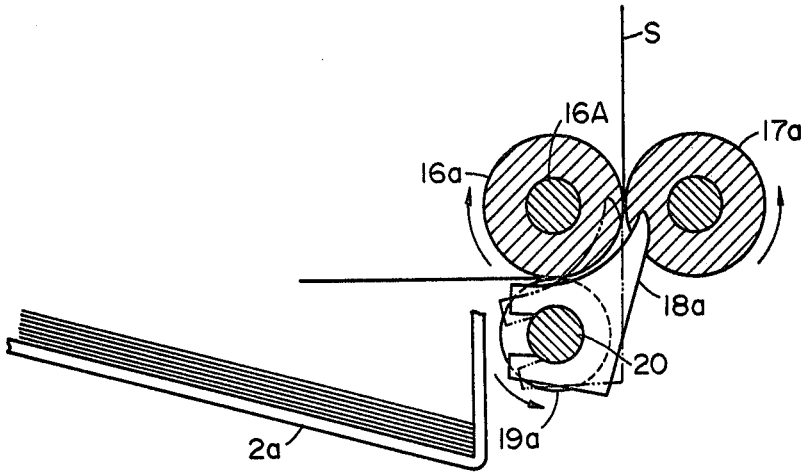
FIG. 3 is an enlarged partial cross-sectional view of the diverting means.

FIG. 3 is an enlarged partial view showing the structure related to said diverting member **18*a*, wherein said diverting member 18*a* and the idler roller 19*a* are rotatably supported in such a manner so as to be freely movable with respect to a non-rotating shaft 16A of the drive roller 16*a*, whereby the sheet S is diverted at the leading end thereof by the diverting member 18*a* when it is in the full-lined position and is securely transported into the tray 2*a* by means of the rollers 16*a* and 19*a***.

Figure 4:
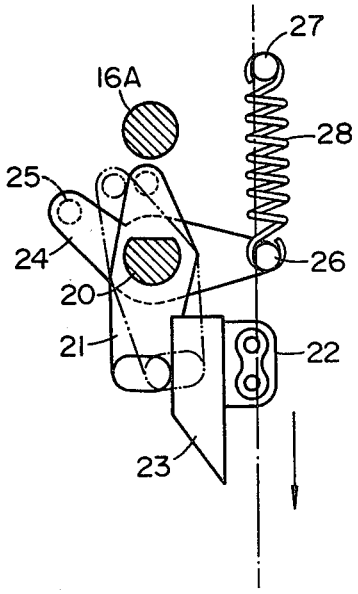
FIG. 4 is an enlarged cross-sectional view of the diverting member.

FIG. 4 shows a drive mechanism for said diverting member in a lateral view, wherein a cam follower 21 mounted on an end portion of a shaft 20 of said roller **19*a* is put into a swinging motion by a cam 23 mounted on a chain 22 advancing in the direction of arrow. Said shaft 20 for supporting said diverting member 18*a* is supported at the ends thereof by arms 24 each of which is supported rotatably at an end thereof by a fulcrum 25 and is biased counter-clockwise at the other end thereof by a coil spring 28 mounted between a pin 26 provided on said arm 24 and a pin 27 provided on said sorter, whereby the roller 19*a* supported by said shaft 20 is suitably maintained in pressure contact with the drive roller 16*a* by means of said coil spring 28**.

The above-explained structure of providing the idler roller 19 on the shaft 20 supporting the diverting member 18 and maintaining said idler roller 19 in pressure contact with the drive roller provides the following advantages. In such structure, the automatic positioning of the diverting member with respect to the drive roller which has been considered difficult in the conventional sorters allows to eliminate the consideration for the alignment of the shaft of said diverting member, the determination of position of said shaft on the side plates and the precision of concentricity with the idler roller, thus achieving simpler assembly, an improved precision, a reduced production cost and an improved function stability. Also this structure allows to securely advance the sheet into the trays 2 by the presence of said idler rollers 19 even when the sheet has a certain end curl resulting from the sheet bending by the diverting member 18. As explained above the presence of the idler roller at the entrance of each tray is highly effective in comparison with the case wherein the sheet is guided into the tray merely by the diverting member.

Now there will be given a further explanation on the drive mechanism for said diverting members while making reference to FIGS. 5 and 6.

Figure 5:
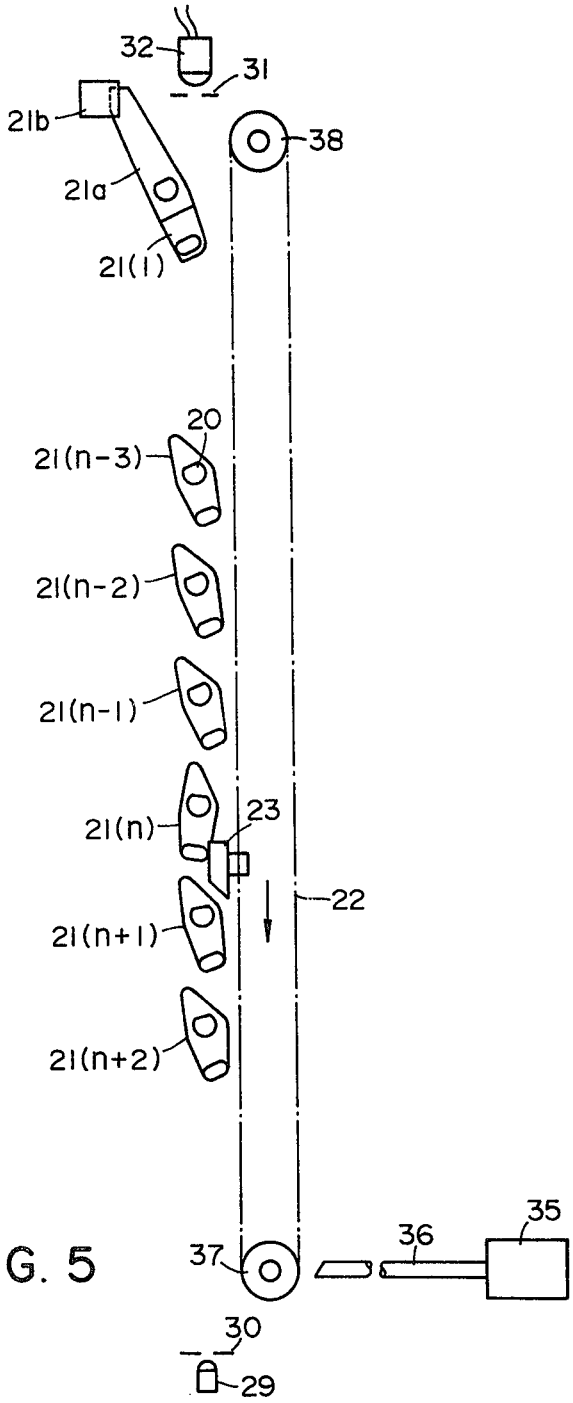
FIG. 5 is a descriptive view showing the positioning method for the diverting member.
Figure 6:
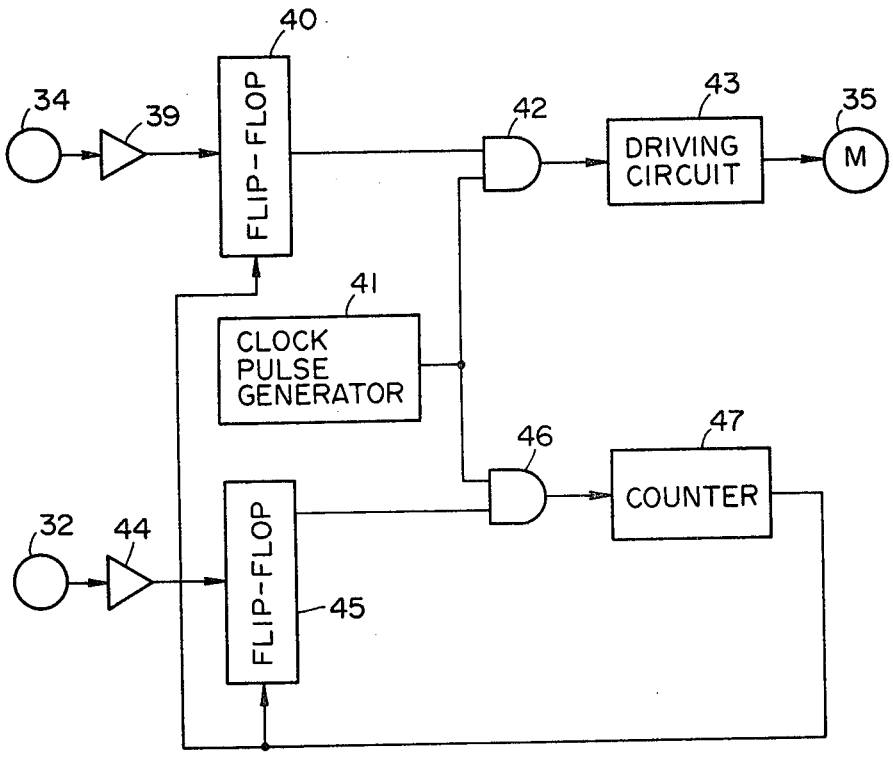
FIG. 6 is a circuit diagram of the drive control circuit for the diverting means.

FIG. 5 shows a cam follower driving mechanism to be employed in the sorter of the present invention, in which a light source lamp 29 emits, through a slit 30, a light beam which is received through a slit 31 by a photosensor 32, said beam being however intercepted by a cam follower 21(n) in case it is positioned to guide the sheet into the corresponding tray.

Upon introduction of a sheet into the n-th tray (*2a*) by the diverting member linked with said cam follower 21 (n), the completion of said introduction is detected by another lamp 33 and an upper photosensor 34 both shown in FIG. 2, of which detection signal activates a stepping motor 35 for driving the chain 22 to rotate a sprocket 37 mounted on a shaft 36 by a determined amount, thereby rotating said chain 22 by a corresponding amount in the direction of arrow and advancing the cam 23 to the succeeding cam follower 21 (n+1). 38 is an idler sprocket provided for providing the chain 22 with an appropriate tension.

Simultaneously with the advancement of the cam 23, the cam follower 21 (n) returns to the initial position by means of the spring 28 shown in FIG. 4, thus allowing said light beam to reach the photosensor 32. Upon further descent the cam 23 causes the succeeding cam follower 21(n+1) to rotate clockwise to again intercept the light beam from the lamp 29, whereby a cam advancement completion signal is generated by the control circuit to terminate the rotation of said motor 35, thus completing the preparation for the succeeding sheet.

In the following explained is another operation mode different from the cam shift mode from the cam follower 21(n) to 21(n+1). In FIG. 5 the first cam follower 21(1) is provided thereon with a light intercepting piece 21*a* of which position is detected by a photosensor 21*b*. Said photosensor 21*b* detects the presence of said light intercepting piece 21*a* in the illustrated state wherein the cam 23 is located at the cam follower 21(n), or in the state wherein said cam 23 is located at any other cam follower except the first one 21(1). Upon application, either manually or from the main apparatus, of a first tray return signal to the unrepresented control circuit for the stepping motor 35, said motor 35 initiates a continuous rotation regardless of the presence or absence of the detection signal from the photosensor 32 until the sensor 21*b* detects the displacement of the piece 21*a* caused by the actuation of the cam follower 21(1) by the cam 23.

In addition to the above-explained method, said returning function to the first tray can also be controlled by detecting the difference between the cam displacing time from the cam follower 21(n) to 21(n+1) and that from the last cam follower 21(k) (not shown) to the first cam follower 21 (1).

Now there will be given an explanation on the drive control circuit for the aforementioned diverting members. Referring to FIG. 6, a signal indicating the completion of sheet storage is supplied from the photosensor 34 through an amplifier 39 to set a flip-flop 40, of which output signal causes the output from a clock pulse generator 41 to be transmitted through an AND gate 42 to a stepping motor drive circuit 43 thereby driving the stepping motor 35. Upon subsequent detection of the completion of cam displacement by the photosensor 32, the signal obtained therefrom is transmitted through an amplifier 44 to set a flip-flop 45, of which output causes said clock pulses to be transmitted through an AND gate 46 to a counter 47. Upon counting of a determined number of clock pulses, said counter 47 releases an output signal to reset the flip-flops 40 and 45, thereby closing the gate 42 and stopping the stepping motor 35. It is also possible to reset the flip-flop 40 directly by the detection signal from the photosensor 32. In such case, however, the diverting member 18 should have completed the displacement to the appropriate position for guiding the sheet into the tray at the moment when the light beam from the lamp 33 is interrupted by the cam follower 21(n).

Furthermore the function of the diverting members can be detected alternatively by a microswitch provided in the vicinity of each diverting member, or a combination of a magnet and a hall element. Such alternative methods are also applicable for the lamp 33 and the photosensor 34 for detecting the completion of sheet storage. Among these equivalent methods, however, the combination of the lamp and the photosensor explained in the foregoing embodiment is advantageous to the others in that a single combination is capable of detecting the function of plural diverting members or the displacement of plural sheets.

As explained in the foregoing, the sorter of the present invention allows a tray arrangement independent from the chain pitch by detecting the function of diverting means with a photosensor and thus controlling the drive mechanism for said diverting means. It is therefore rendered possible to reduce the dimension of the entire sorter and to arrange the trays according to the purpose. In addition the use of highly reliable stepping motor and the absence of clutch or brake allow to significantly simplify the drive mechanism, thereby enabling to compactize the drive system and to reduce the possibility of mechanical troubles.

Figure 7:
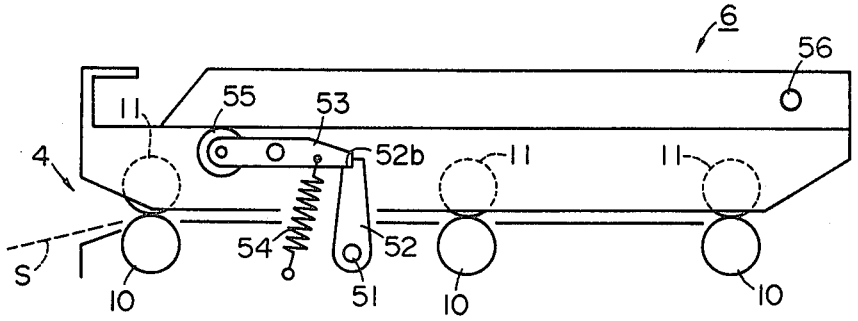
FIGS. 7 and 8 are partial cross-sectional views showing the opening mechanism of the upper door.
Figure 8:
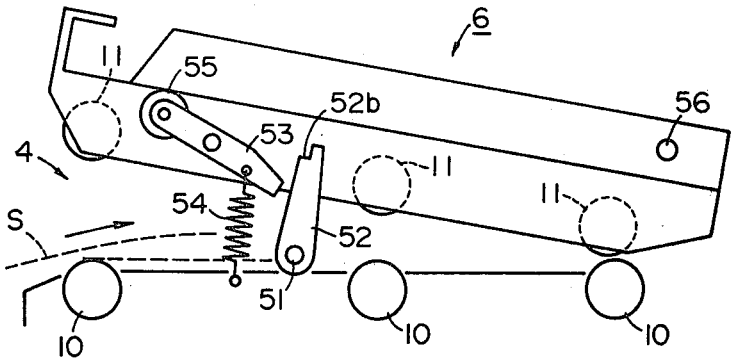

Finally there will be given an explanation, with reference to FIGS. 7 and 8, on a mechanism designed to cope with the eventual sheet jamming in the sorter of the present invention.

In case of a sheet jamming in the transport path in the sorter, there is generated a jam signal by jam detecting means 58 provided in the vicinity of the entrance slot 4 (cf. FIG. 2) or by the aforementioned detecting means composed of the lamp 33 and sensor 34 provided in the vertical transport path. Such jam detection can be achieved by a conventionally known method, for example by a time comparison with a timer or by a counter for counting clock pulses generated in proportion to the transport speed.

Figure 9:
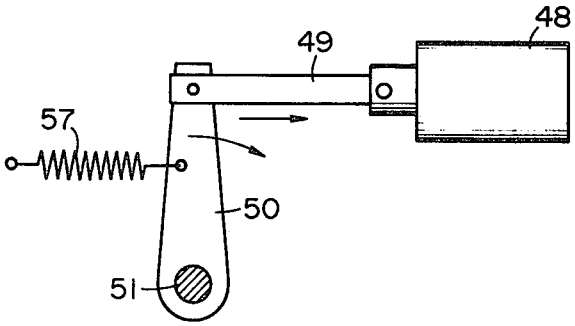
FIG. 9 is an elevation view of the trigger portion for said opening mechanism.

Said jam signal is supplied to a control circuit in the main apparatus to interrupt the sheet feeding to the image forming section, while the sheet feeding for the sheets already subjected to the image forming process is continued until such sheets are completely ejected from the main apparatus. On the other hand said jam signal functions in the sorter 1 to stop the transport rollers therein, to open the upper horizontal transport path by means of a mechanism to be explained in the following and to temporarily accumulate the sheets advanced from the main apparatus in thus opened horizontal transport path. The above-mentioned mechanism is shown in FIGS. 7 to 9. Upon receipt of said jam signal, a solenoid 48 shown in FIG. 9 is energized to attract a link 49 connected thereto in the direction indicated by the arrow, thereby rotating clockwise an arm 50 linked to the end of said link 49 and rotatably supported by a shaft 51. The resulting rotation of said shaft 51 causes a clockwise rotation of an opening arm 52 (FIG. 7) mounted thereon, thereby releasing from an upper recess 52*b* a lift arm 53 which is biased clockwise about a central shaft by a spring 54 connected to an end of said lift arm and is provided on the other end thereof with a roller 55. Thus, upon clockwise rotation of the opening arm 52 by said solenoid 48, said lift arm 53 opens the upper door 6 in the clockwise direction about a shaft 56 as shown in FIG. 8.

In such open state, the sheets S which still continue to be advanced from the main apparatus can be temporarily accumulated in the opened horizontal transport path despite the fact that the transport rollers in the sorter 1 are not in function. In this state the operator performs the procedure necessary for eliminating the jammed state, i.e. removing the jammed sheets from the transport path, removing the sheets accumulated in the horizontal transport path of the sorter and closing the opened doors. Said upper door 6 can be closed by anticlockwise rotation about the shaft 56, whereby the arm 52 returns to the original position by the tension of a spring 57 shown in FIG. 9. In order to smoothly accumulate the sheets on the horizontal transport path when said upper door 6 is opened, the sheet advancing trajectory from the entrance slot should preferably be not in the tangential direction of the rollers 10, 11 when said door 6 is closed but directed somewhat toward the upper rollers 11.

As explained in the foregoing, the temporary accumulation of sheets in process in the transport path itself eliminates the necessity for an emergency tray, thus enabling to reduce the entire dimension of the sorter. Also the operation can be rapidly restarted after jamming since the inspection can be limited to the transport path used in the ordinary operation.

What we claim is:

1. A sheet sorting and stacking apparatus for sorting and stacking sheet materials into plural storage positions, comprising:

upper and lower transport means for transporting sheet materials from a sheet entrance to said storage positions;

an auxiliary member pivotable to be released together with one of said upper and lower transport means from the other of said upper and lower transport means so as to provide a widened sheet material transport path;

means for detecting the occurrence of abnormal sheet transportation and releasing said auxiliary member upon the detection; and means for stopping operation of said upper and lower transport means and allowing one of said upper and lower transport means to function to stack the sheet materials, after said detecting and releasing means detects the occurrence of abnormal sheet transportation and releases said auxiliary member.

2. An apparatus according to claim 1, wherein said transport means include a horizontal transport path at an upper portion of said apparatus.

3. An apparatus according to claim 1, further comprising a group of trays each for accommodating plural sheet materials downstream of said transport means, and a pair of rollers provided adjacent each of the entrances of said trays, and deflecting means, pivotable and coaxial with respect to one of said rollers, for deflecting the sheet materials to direct them into said trays.

* * * * *